United States Patent [19]

Berkes et al.

[11] Patent Number: 4,766,288

[45] Date of Patent: Aug. 23, 1988

[54] FLASH FUSING REFLECTOR CAVITY

[75] Inventors: John S. Berkes, Webster; Stanley B. Swackhamer, Pittsford, both of N.Y.

[73] Assignee: Xerox Corporation, Stamford, Conn.

[21] Appl. No.: 85,824

[22] Filed: Aug. 17, 1987

[51] Int. Cl.[4] ..... H05B 33/24

[52] U.S. Cl. ..... 219/216; 219/347; 219/349; 219/343; 355/3 FU

[58] Field of Search ..... 219/216, 347, 349, 343, 219/388; 355/3 FU, 14 FU; 362/297, 345, 346, 347, 341, 294, 96

[56] References Cited

U.S. PATENT DOCUMENTS

| | | | |
|---|---|---|---|
| 1,307,556 | 6/1919 | Kuhn | 219/342 |
| 2,143,673 | 1/1939 | Baumgartner | 362/346 |
| 2,694,139 | 11/1954 | Zurawski | 362/346 |
| 3,529,129 | 9/1970 | Rees | 219/216 |
| 4,336,576 | 6/1982 | Crabtree | 362/346 |
| 4,403,275 | 9/1983 | Oser | 362/346 |
| 4,536,830 | 8/1985 | Wisniewski | 362/346 |
| 4,562,517 | 12/1985 | Pankin | 362/346 |

FOREIGN PATENT DOCUMENTS

| | | | |
|---|---|---|---|
| 58-186772 | 10/1983 | Japan | 355/14 FU |

*Primary Examiner*—E. A. Goldberg
*Assistant Examiner*—Teresa J. Walberg
*Attorney, Agent, or Firm*—Ronald F. Chapuran

[57] ABSTRACT

A fuser having an illuminator disposed within a relatively narrow box-like cavity, the cavity including a plurality of reflecting surfaces to produce substantially uniform radiation across the cavity, the reflecting surfaces including a flat diffuse reflector, an essentially parabolic diffuse reflector, an a specular reflector disposed at one end of the parabolic diffuse reflector.

3 Claims, 4 Drawing Sheets

FLASH FUSING REFLECTOR CAVITY

BACKGROUND OF THE INVENTION

This invention relates to fuser heating apparatus and, in particular, to apparatus to produce uniform irradiance in a fusing cavity.

Many forms of image fusing techniques are known in the prior art such vapor fusing, heat fusing, pressure fusing or a combination thereof. Each of these techniques suffer from deficiencies which make their use impractical or difficult for specific xerographic applications, such as in reproducing apparatus capable of producing copies at an extremely rapid rate. Radiant flash fusing is one practical method of image fixing that lends itself to use in a high speed automatic process. The main advantage of the flash fuser over the other known methods is that energy, which is propagated in the form of electro-magnetic waves, is instantaneously available and requires no intervening medium for its propagation. It does not require long warm-up periods nor does the energy have to be transferred through a relatively slow conductive or convective heat transfer mechanism.

A major problem with flash fusing, however, in the xerographic fixing art has been designing apparatus which can fully and efficiently use a preponderance of the radiant energy emitted by the source during the relatively short flash period. In flash fusing, it is especially important to maintain a very uniform output across the entire flash cavity. To minimize power supply size, energy output should be set just slightly above the minimum fuse temperature. Minimal fluctuations in space in the energy output can easily result in under fusing parts of a copy and thereby require excess energy input to insure uniformity of fusing across the entire copy.

U.S. Pat. No. 3,529,129, commonly assigned, discloses a method to fix an electroscopic image to a final support material in which the image bearing support material is placed within an integrating cavity and exposed to radiation emitting from a flash lamp. The cavity wall, the flash lamp, and the support material are positioned in relation to each other such that the electroscopic powder is fixed sufficiently and uniformly. The radiant energy source and the image bearing support material to be fixed are placed within the reflective cavity which is constructed to functionally approximate an integrating sphere. A difficulty with this system is that it is relatively complex and is not easily adapted to fuser cavities that are relatively narrow or shallow.

It is an object of the present invention, therefore, to provide a new and improved flash fusing reflector cavity. It is another object of the present invention to provide a relatively shallow fuser reflector cavity having a combination of specular and diffuse reflecting surfaces to provide uniform irradiation with a minimum of power.

Further advantages of the present invention will become apparent as the following description proceeds, and the features characterizing the invention will be pointed out with particularity in the claim annexed to and forming a part of this specification.

The present invention is a fuser having an illuminating means disposed within a relatively narrow box-like cavity, the cavity including a plurality of reflecting surfaces to produce substantially uniform radiation across the cavity, the reflecting surfaces including a combination of diffuse and specular surfaces, in particular, a flat diffuse reflector, an essentially parabolic diffuse reflector, an a specular reflector disposed at one end of the parabolic diffuse reflector.

For better understanding of the present invention, reference may be had to the accompanying drawings wherein the same reference numerals have been applied to like parts and wherein:

FIGS. 1*a* and 1*b* illustrate typical prior art fuser cavities;

Figure 1A:
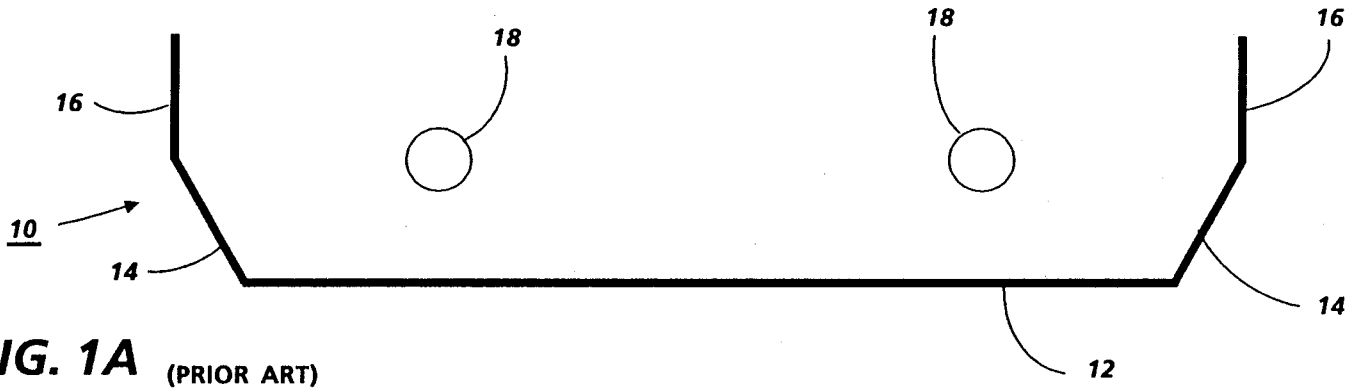
FIG. 1A (PRIOR ART)

With reference to FIG. 1*a* there is shown generally at 10 a typical prior art fuser box cavity having a flat bottom surface 12 terminating in a pair beveled corners 14 extending into vertical side walls 16. The bottom wall 12, the beveled corners 14 and the side walls 16 are coated or covered with a white diffuse reflecting surface such as $T_iO_2$ or $M_gO$ coating or any other suitable material. A pair of flash lamps 18 provide illumination. Another typical prior art fusing box cavity is illustrated in FIG. 1*b* with the addition of a pair of diffuse reflecting parabolic sides 20 and central gullwing 22 with peaked center, having a specular reflecting surface such as polished aluminum or any other suitable material.

Figure 1B:
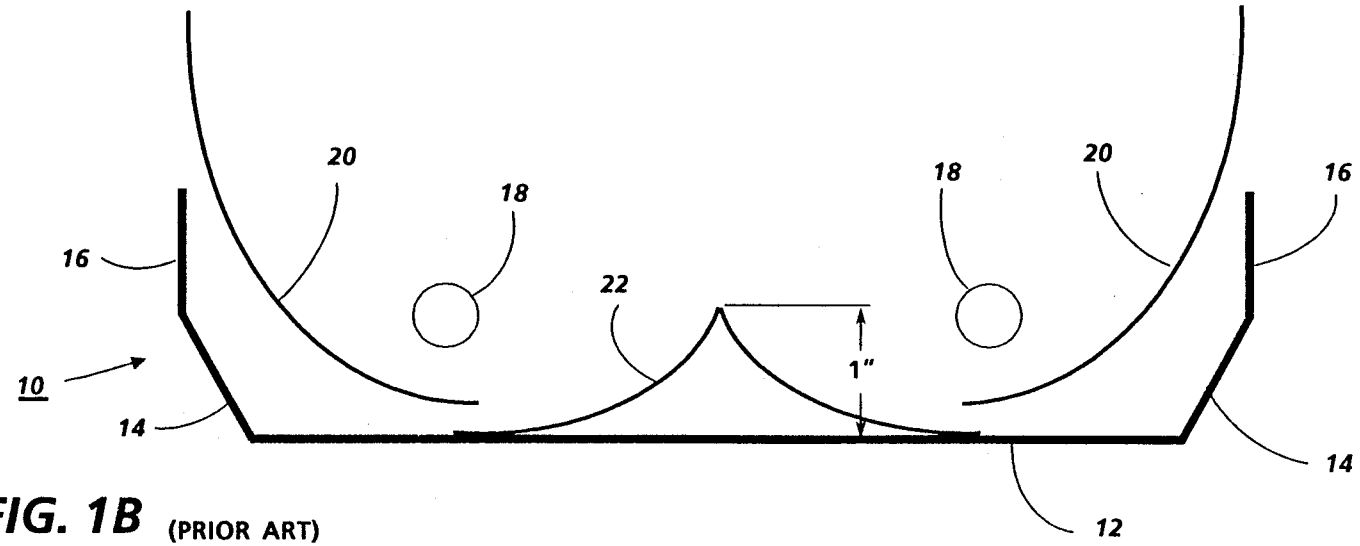
FIG. 1B (PRIOR ART)
Figure 2:
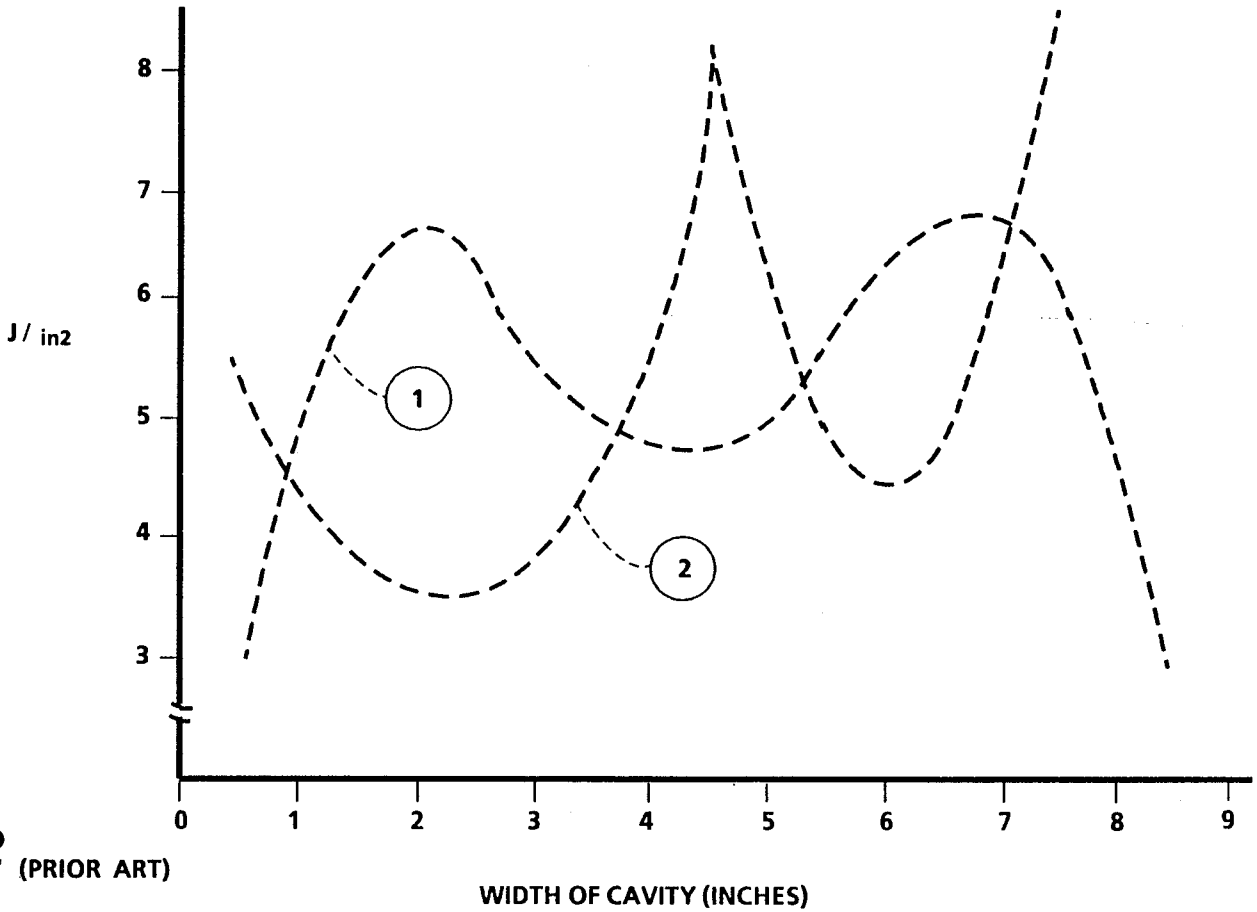
FIG. 2 (PRIOR ART)
FIG. 2 illustrates the energy distribution in the cavities shown in FIGS. 1*a* and 1*b;*

FIG. 2 illustrates the energy distribution from the lamps 18 for the configurations shown in FIGS. 1*a* and 1*b*. The x axis plots the width of the cavity 10 in inches as a function of the y axis plotting the energy in joules per square inches along the width of the cavity. Curve number 1 illustrates the energy distribution for the arrangement shown in FIG. 1*a*, a very uneven and undesirable energy distribution with significant peaks and valleys along the width of the cavity. If a minimum fusing energy were assumed to be 5 joules per square inch, then the arrangement as illustrated in FIG. 1*a* would provide an insufficient amount of energy at the edges of the cavity. Curve number 2 illustrates the energy distribution along the width of the cavity for the arrangement as illustrated in FIG. 1*b*. Likewise, a very uneven and undesirable energy distribution is shown that would not provide a sufficient amount of energy at the two valleys and would provide excess energy at the peak.

Figure 3:
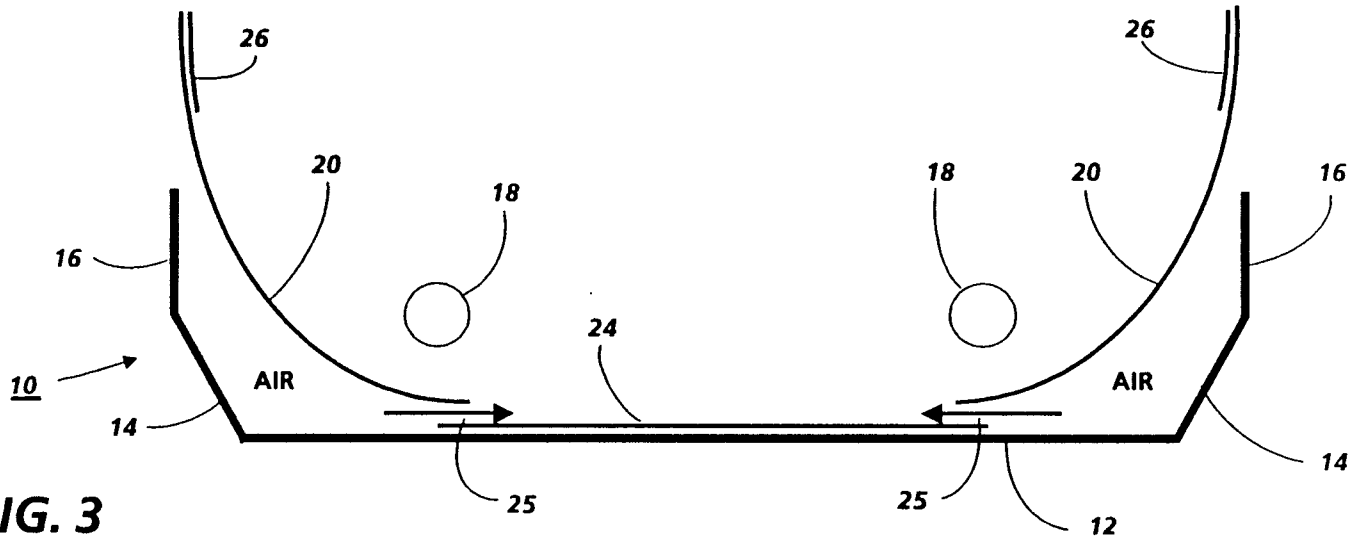
FIG. 3 is a flash fusing reflector cavity in accordance with the present invention.

In accordance with the present invention, with reference to FIG. 3, the specular reflecting gullwing 22 of FIG. 1*b* is replaced by a flat diffuse surface 24 and a polished aluminum specular reflecting strip 26 is placed on the upper edge of each of the parabolic diffuse surface 20. The surfaces 12 and 24, the beveled corners 14 and side walls 16 together with the parabolic sides 20 and strips 26 form the cavity at least partially enclosed and containing the lamps 18 disposed therein. It should be understood that the flash lamps 18 generally are capable of emitting radiant energy at wavelengths at which toner particles are highly absorptive. The remainder of the parabolic reflectors 20 still provide a diffuse reflecting surface. Preferably, the specular strips 26 are of polished aluminum or any other suitable material and are approximately ¾" to 1" wide. For a relatively shallow reflector cavity in the order of 3" to 6" over a cavity of approximately 9" in width, the combination of the specular reflecting strips 26 on the diffuse reflecting parabolic reflectors 20 and the diffuse reflecting flat strip 24 provide a uniform energy distribution of the lamps 18 across the entire width of the fusing cavity 10.

In addition to the above disclosed features, the fuser cavity in FIG. 3 also has a gap 25 between the parabolic sides 20 and the flat diffuse surface 24. This feature allows for air to be passed into the reflector cavity to keep the reflector cavity clean and cool.

Figure 4:
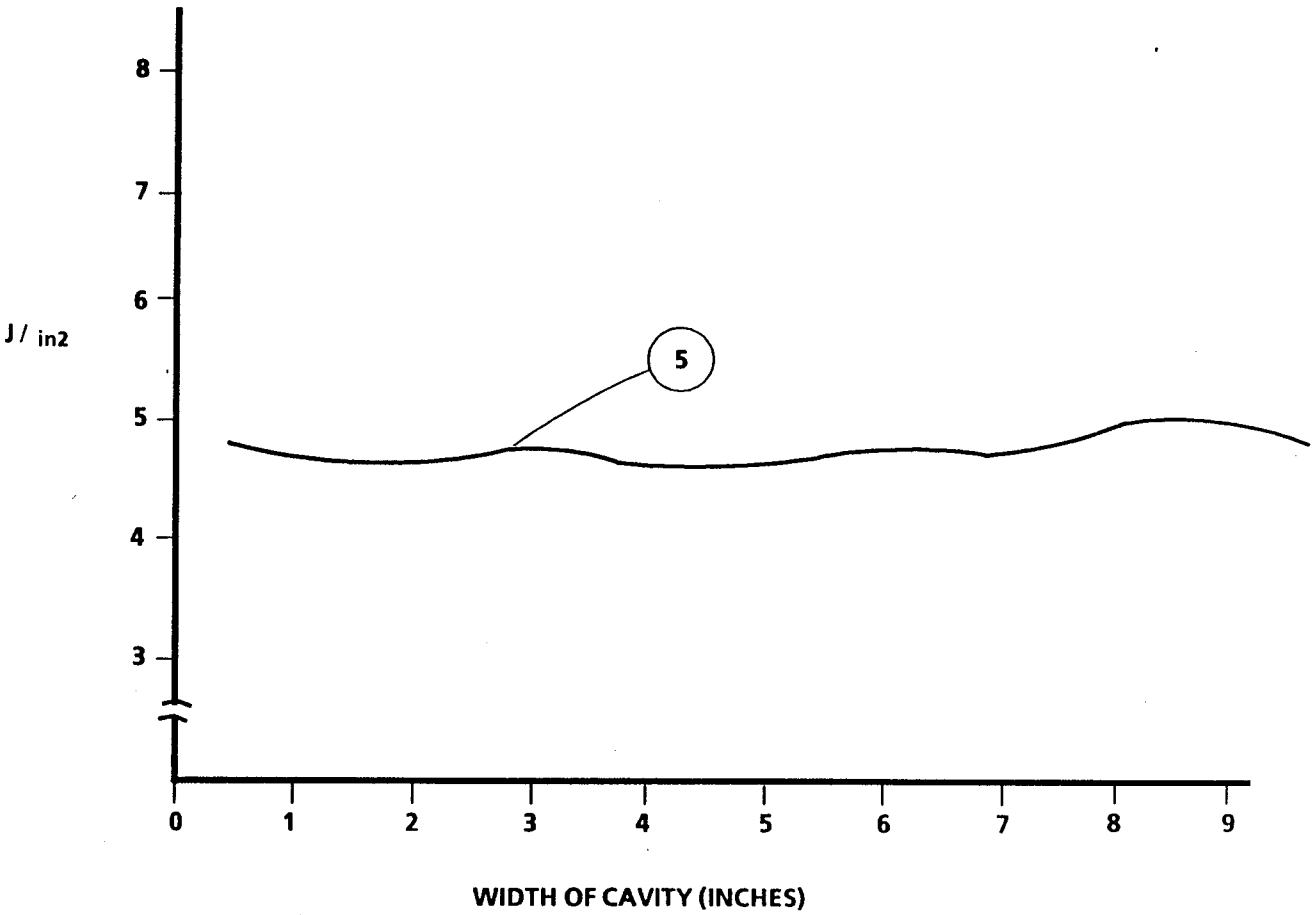
FIG. 4 is an illustration of the energy distribution in the reflector cavity of FIG. 3 in accordance with the present invention.

With reference to FIG. 4, there is illustrated the energy distribution of the arrangement shown in the FIG. 3. In particular, there is a relatively even distribution of approximately 5 joules per square inch as shown in the vertical axis in FIG. 4 across the entire width of the fuser cavity as shown along the horizontal or x axis. This relatively uniform energy distribution is maintained at both edges of the cavity as well as through the center of the cavity. Thus, a much less energy input is required. For example, the fusing energy required is approximately 5 joules per square inch to maintain this energy level across the width of the cavity. On the other hand, with reference to FIG. 2, a much higher level of energy would be required for either of the arrangements in FIG. 1*a* and FIG. 1*b* to ensure that there was at least approximately 5 joule per square inch energy level across the entire width of the cavity. The combination of the diffuse and specular reflectors in a relatively shallow cavity eliminates the need to drastically overfuse in some areas to achieve minimal fusing in other areas. This provides for a considerable energy input saving.

While there has been illustrated and described what is at present considered to be a preferred embodiment of the present invention, it will be appreciated that numerous changes and modifications are likely to occur to those skilled in the art, and it is intended in the appended claims to cover all those changes and modifications that fall within the true spirit and true scope of the present invention.

I claim:

1. Apparatus for fusing heat fixable toner images to a final support material upon which toner images are loosely adhering comprising:

illuminating means capable of emitting radiant energy at wavelengths at which the toner images are highly absorptive, a substantially enclosed cavity, the illuminating means disposed therein, said cavity including a plurality of reflecting surfaces arranged in proximity to the illuminating means to produce substantially uniform radiation across the cavity, the reflecting surfaces including a flat diffuse reflector, at least two essentially parabolic diffuse reflectors, and a specular reflector disposed at a first end of each of the parabolic diffuse reflectors, a second end of each of the parabolic diffuse reflectors being disposed near the flat diffuse reflector, the flat diffuse reflector and the parabolic diffuse reflectors forming a gap allowing flow of air.

2. The apparatus of claim 1 wherein the specular reflector is an essentially rectangular strip in the range of 0.5 to 1.5 inches wide.

3. The apparatus of claim 1 wherein the cavity is approximately 9 inches wide, 12 inches long and 3 inches deep.

* * * * *